US006422652B1

(12) United States Patent
Roslund, Jr. et al.

(10) Patent No.: US 6,422,652 B1
(45) Date of Patent: Jul. 23, 2002

(54) HEIGHT ADJUSTING MECHANISM

(75) Inventors: Richard N. Roslund, Jr., Jenison; Troy Roark, West Olive, both of MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/726,135

(22) Filed: Nov. 29, 2000

(51) Int. Cl.[7] ..... B60N 2/02
(52) U.S. Cl. ..... 297/353; 297/411.36
(58) Field of Search ..... 297/353, 411.36

(56) References Cited

U.S. PATENT DOCUMENTS

| | | | | |
|---|---|---|---|---|
| 4,451,084 A | | 5/1984 | Seeley | |
| 4,639,039 A | | 1/1987 | Donovan | |
| 4,749,230 A | | 6/1988 | Tornero | |
| 5,037,158 A | | 8/1991 | Crawford | |
| 5,176,356 A | * | 1/1993 | Lorbiecki et al. | 248/577 |
| 5,586,809 A | * | 12/1996 | Szmadzinski | 297/353 |
| 5,588,766 A | | 12/1996 | Lai | |
| 5,597,204 A | | 1/1997 | Karaus, Jr. | |
| 5,620,233 A | | 4/1997 | Corwin | |
| 5,649,741 A | | 7/1997 | Beggs | |
| 5,685,609 A | | 11/1997 | Miotto | |
| 5,695,249 A | | 12/1997 | Lotfi | |
| 5,725,278 A | | 3/1998 | Verbeek | |
| 5,735,577 A | | 4/1998 | Lin | |
| 5,765,920 A | | 6/1998 | Lai | |
| 5,791,734 A | | 8/1998 | Malenotti | |
| 5,853,222 A | * | 12/1998 | Roslund, Jr. et al. | 297/353 |
| 5,879,054 A | | 3/1999 | Cao | |

* cited by examiner

*Primary Examiner*—Peter M. Cuomo
*Assistant Examiner*—Joseph Edell
(74) *Attorney, Agent, or Firm*—Flynn, Thiel, Boutell & Tanis, P.C.

(57) ABSTRACT

A height adjusting mechanism is connected between a rigid upright extending upwardly from the seat assembly and an inner shell of the back assembly. The height adjusting mechanism includes a ratcheting latch which engages a vertically elongate rack to maintain the back assembly at a selected elevation and a release lever or cam which is connected to the catch and automatically disengages the catch from the rack at the upper limit of travel of the back assembly. The release cam continuously contacts the inner shell of the back assembly and is deactivated merely by a short upward shifting of the back assembly which thereby permits the pawl to reengage the rack at any desired elevation. Accordingly, reengagement of the pawl with the rack can be accomplished at any point between the upper and lower limits of travel of the back assembly.

20 Claims, 12 Drawing Sheets

HEIGHT ADJUSTING MECHANISM

FIELD OF THE INVENTION

The invention relates to a height adjusting mechanism for an office chair, and more particularly, to a height adjusting mechanism which permits vertical adjustment of a back assembly of the chair.

BACKGROUND OF THE INVENTION

Conventional office chairs have a seat assembly as well as a back assembly which extends upwardly from a rear edge of the seat assembly for respectively supporting the seat and back of the chair occupant. The seat assembly typically supports a rigid upright and the back assembly is supported on the upright. Also, such chairs often include a pair of chair arms which extend upwardly from the opposite side edges of the seat assembly for supporting the occupant's arms.

To provide more comfortable office chairs, many of the chair components are adjustable in various directions so that the components of the chair more closely conform to and comfortably support the seat, arms and back of the occupant. In this regard, it is well known to provide a height adjusting mechanism in the back assembly of the chair which permits the height of the chair to be adjusted relative the to seat assembly. Height adjusting mechanisms also are known to be provided in the chair arms to permit vertical adjustment of the chair arm.

With respect to such height adjusting mechanisms and primarily those height adjusting mechanisms used in the back assembly, many of these mechanisms include ratchet-like mechanisms having a vertically elongate row of teeth, which define a rack, and a pawl which engages the rack. These ratchet mechanisms permit the back assembly to be manually lifted upwardly along the upright which mechanisms maintain the back assembly at a selected elevation when the occupant releases the back assembly.

Many of these mechanisms include actuator parts such as levers, pins and the like which act on the pawl when the back assembly is at the upper limit of vertical travel to separate the pawl from the rack and permit downward sliding, i.e. manual lowering of the back assembly to a lowered position. Such height adjusting mechanism includes further actuator parts at the lower end of travel which automatically disengage the lever, pins or the like to release or reset the pawl and permit the pawl to reengage the rack. With such height adjusting mechanisms, however, it is necessary to lower the back assembly to the lowermost position before the pawl is reset, i.e. is able to reengage the rack, and again permit upward adjustment of the height of the back assembly.

It is an object of the invention to provide an improved height adjusting mechanism which overcomes this and other disadvantages associated with prior height adjusting mechanisms.

The height adjusting mechanism of the invention is connected between a rigid upright extending upwardly from the seat assembly and an inner shell of the back assembly. The inventive height adjusting mechanism includes a lever-like latch which engages a vertically elongate rack to maintain the back assembly at a selected elevation, wherein the teeth of the rack define a plurality of incrementally spaced apart elevations. The latch is pivotable outwardly away from the teeth in a ratcheting manner to permit lifting of the back assembly upwardly to a selected one of the predefined elevations at which the latch engages the rack to maintain the back assembly at the selected elevation.

The latch further includes a release lever or cam which is pivotally connected to the catch so as to move therewith. The cam normally is in an inactive stored position which permits the latch to ratchet along the rack. However, the cam is pivoted at the upper end of travel of the back assembly toward the rack which causes the latch to move in an opposite direction away from the rack to a disengaged position which thereby allows lowering of the back assembly.

The release cam continuously contacts the inner shell of the back assembly during downward movement of the back assembly. However, due to frictional contact between the cam and a rack surface, the cam can be moved back to the stored position by a short upward shifting or reversal of the back assembly such that the latch reengages the rack. Accordingly, reengagement of the latch with the rack can be accomplished at any point between the upper and lower limits of travel of the back assembly. This thereby eliminates the need to drop the back assembly to the lower limit to reset the latch as is otherwise required in many known height adjusting mechanisms.

Other objects and purposes of the invention, and variations thereof, will be apparent upon reading the following specification and inspecting the accompanying drawings.

Figure 1:
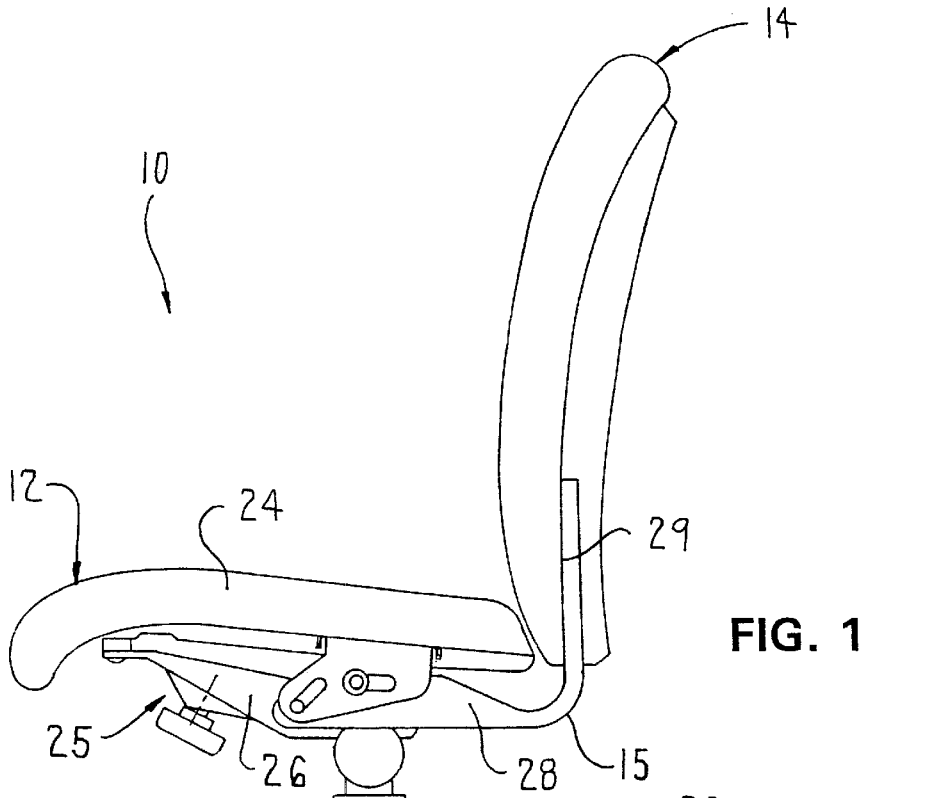
FIG. 1 is a side elevational view of an office chair.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
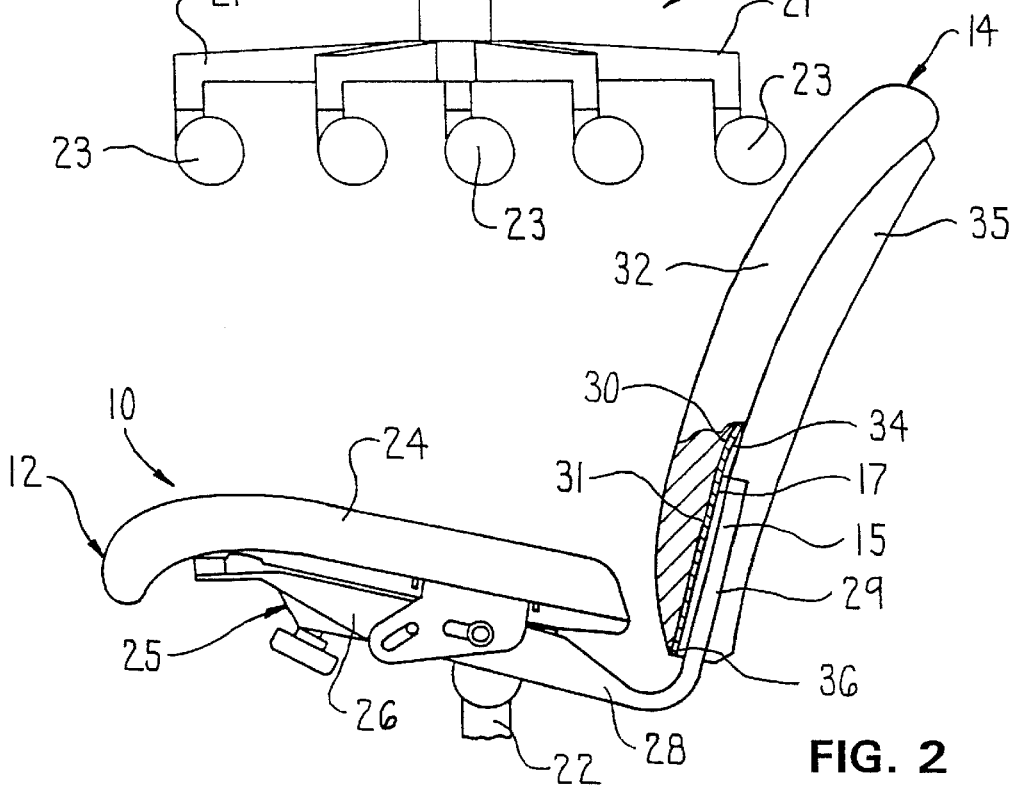
FIG. 2 is a side elevational view in partial cross-section diagrammatically illustrating a height adjusting mechanism of the invention connected between an upright of the seat assembly and an inner shell of the back assembly.

Referring to FIGS. 1 and 2, an office chair 10 is illustrated which includes a seat assembly 12 and a back assembly 14. The seat assembly 12 includes a generally L-shaped upright 15 which projects upwardly above the rear edge of the seat assembly 12 and supports the back assembly 14 thereon. A height adjusting mechanism 17 is diagrammatically illustrated in FIG. 2 connected between the back assembly 14 and the upright 15 wherein the height adjusting assembly 17 is disengaged at an upper travel limit to permit the back assembly 14 to be lowered and is reset at any elevation between the upper and lower travel limits.

The office chair 10 includes a base 20 having a plurality of legs 21 which extend radially outwardly from a lower end of the vertical pedestal 22. The outer ends of the legs 21 include conventional casters 23 which support the office chair 10 on a floor or other similar surface.

The upper end of the pedestal 22 rigidly supports the seat assembly 12 thereon. In particular, the seat assembly 12 includes a horizontally enlarged seat cushion 24 which seat cushion 24 overlies and is supported on the pedestal 22 by a tilt control mechanism 25. The tilt control mechanism 25 includes a control housing 26 which is rigidly connected to the pedestal 22, and furthermore supports the upright 15 which is pivotally connected to the control housing 26.

Figure 5:
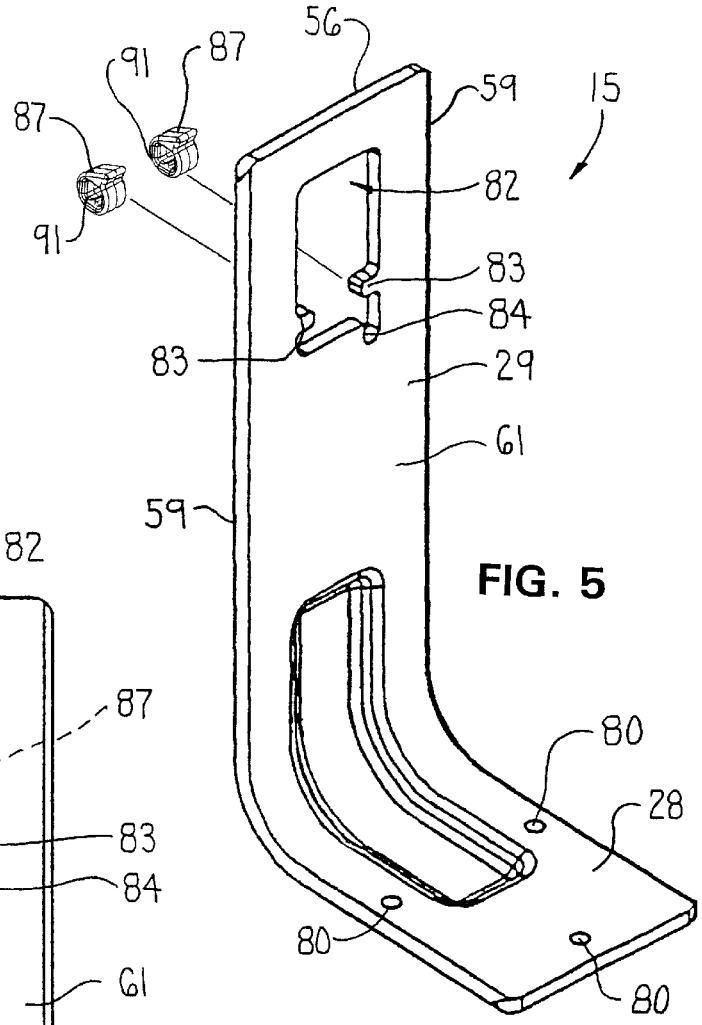
FIG. 5 is a front perspective view of the upright illustrating a pair of bearings which mount to the upright for connecting the height adjusting mechanism to the upright.

The upright 15 is rigid and includes a generally horizontal leg 28 and a generally vertical leg 29 as seen in FIGS. 2 and 5. The front end of the horizontal leg 28 is pivotally connected to the control housing 26 while the vertical leg 29 extends upwardly from the rear end of the horizontal leg 28. The vertical leg 29 is disposed rearwardly of the seat cushion 24 and supports the back assembly 14 on the upper end thereof.

The pivotal connection of the upright 15 to the control housing 26 thereby permits rearward tilting of the back assembly 14 relative to the seat assembly 12 by the chair occupant. With the particular tilt control mechanism 25, the rear edge of the seat assembly of 12 also pivots downwardly relative to the front edge thereof.

Referring to FIGS. 1–4, the back assembly 14 includes a vertically enlarged plastic inner shell 30 which is covered on the front face 31 thereof by a cushion 32. The back face 34 of the inner shell 30 is covered by a vertically enlarged plastic outer cover 35 which completely covers the inner shell 30 and mates with the back cushion 32 about the periphery thereof to provide a finished appearance to the back assembly 14.

The lower end of the back assembly 14 includes a downward opening pocket 36 which pocket 36 generally is defined between back face 34 of the inner shell 30 and an opposing inner face of the cover 35. The pocket 36 is adapted to receive the upper end of the upright 15 therein wherein the upright 15 is inserted upwardly into this pocket 36. As will be discussed in more detail hereinafter, the back assembly 14 is slidable vertically along the upper end of the upright 15 to permit adjustment of the height of the back assembly 14 relative to the seat assembly 12.

The upper end of the upright 15 further includes the height adjusting mechanism 17 which is provided to control adjustment of the vertical height of the back assembly 14 and support the back assembly 14 at a selected elevation. The height adjusting mechanism 17 is supported on a front face of the upright 15 and cooperates with the back face 34 of the inner shell 30 to define a ratchet-like connection therebetween.

Figure 3:
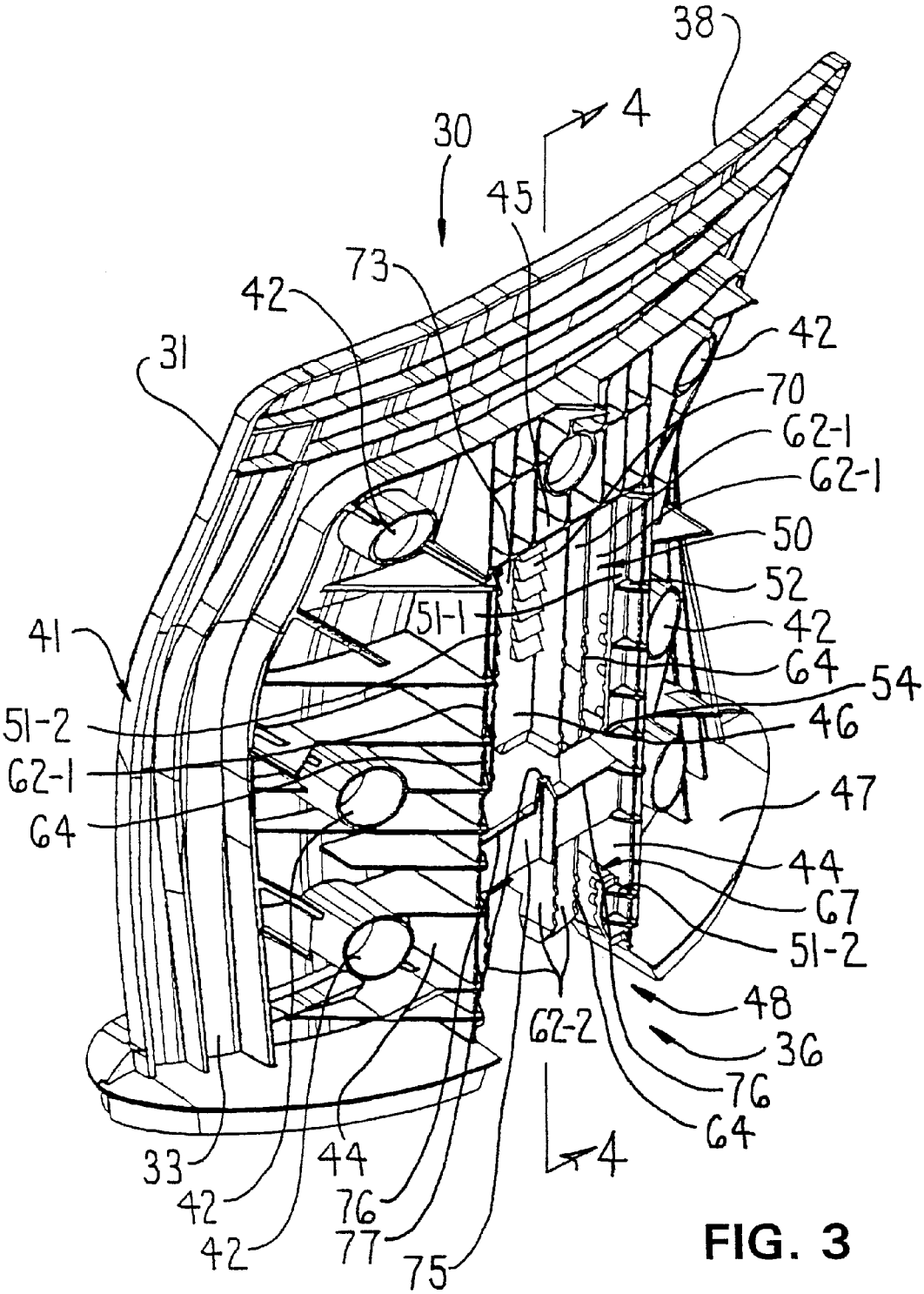
FIG. 3 is a rear perspective view of the inner shell of the back assembly.
Figure 4:
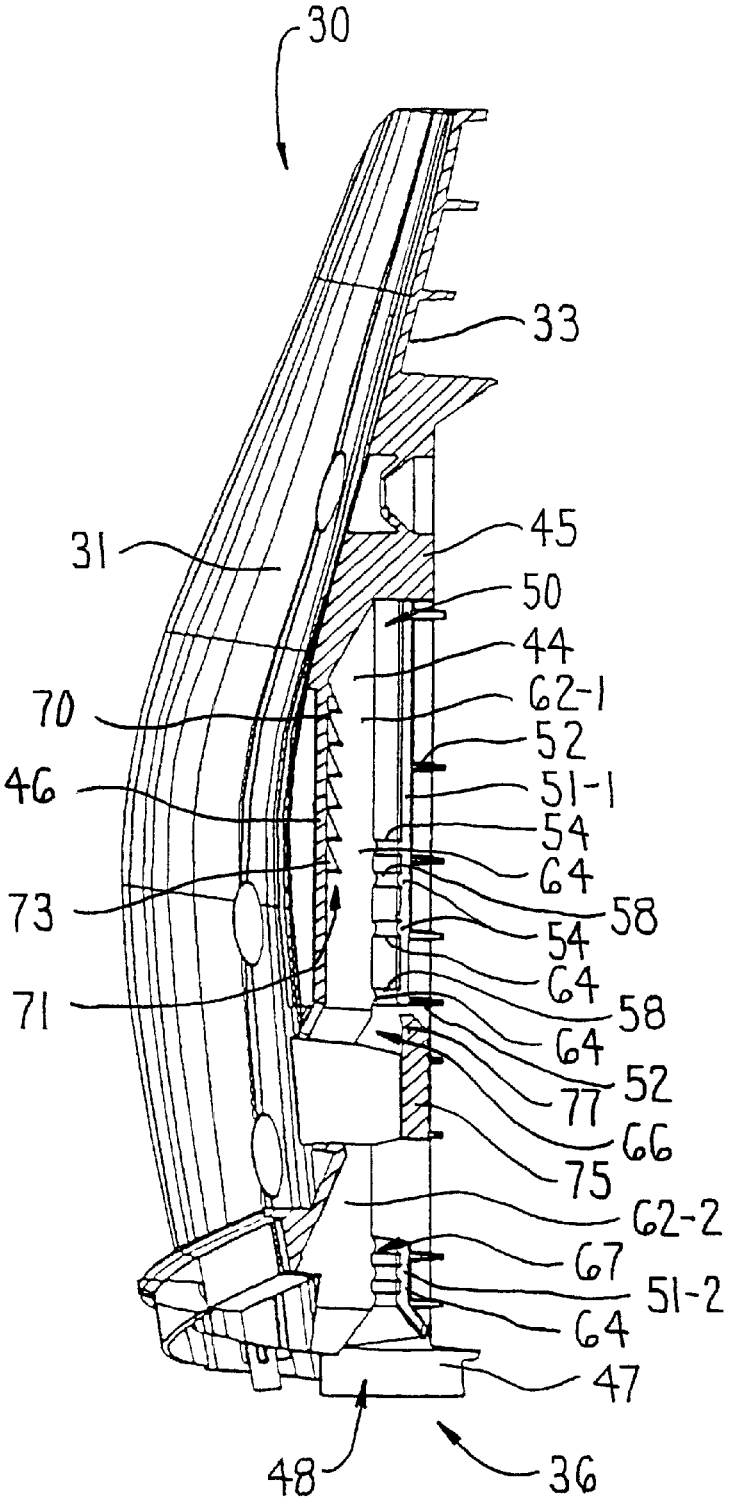
FIG. 4 is a side elevational view in cross-section of the inner shell as taken along line 4—4 of FIG. 3.

More particularly with respect to the inner shell 30 (FIGS. 3 and 4), the inner shell 30 preferably has a molded one-piece construction. The front face 31 has a generally conventional ergonomic shape which curves rearwardly at the upper end thereof, and curves forwardly along the opposite left and right side edges thereof as generally illustrated in FIG. 4 and more specifically indicated by the curved upper edge 38 of FIG. 3.

With respect to the back face 34, ribbing 41 is provided thereon which projects rearwardly and defines a plurality of horizontal and vertical ribs that strengthen the inner shell 30. The ribbing 41 further includes a plurality of cylindrical fastener pockets 42 which open rearwardly and are provided to permit securement of the outer cover 34 to the back face 33.

The ribbing 41 further defines the pocket 36. More particularly, the ribbing 41 includes a pair of vertically elongate side walls 44 and an upper wall 45 which extends sidewardly between the upper ends of the side walls 44. The inner shell 30 further includes a vertical front pocket wall 46. Accordingly, the side walls 44, the upper wall 45 and the front pocket wall 46 thereby define the pocket 36 which is vertically elongate and opens both rearwardly and downwardly to permit the upright 15 to be slidably inserted upwardly therein.

The inner shell 30 further includes a bottom shell wall 47 which generally encloses the bottom of the back assembly 14 but is notched in the center area thereof to define a generally rectangular lower opening 48 of the pocket 36.

To support the upright 15 within the pocket 36, the inner shell 30 includes vertically elongate grooves 50 (FIGS. 3, 4, 11 and 12) which grooves 50 are defined on a rear side thereof by upper and lower flanges 51-1 and 51-2. The flanges 51-1 and 51-2 project sidewardly from the side walls 44 and are strengthened by gussets 52. The front face of each flange 51-1 and 51-2 further includes arcuate projections 54 which are adapted to contact a back side 56 of the upright 15 and minimize friction therebetween. The side walls 44 also have additional arcuate projections 58 (FIGS. 4 and 13) which project inwardly from the side walls 44 and slidably contact the respective side edge 59 of the upright 15.

To slidably support the front face 61 of the upright 15, the front pocket wall 46 further includes pairs of ribs 62-1 and 62-2 which project rearwardly from the front pocket wall 46 and are sidewardly spaced apart. The rear terminal edges of the ribs 62-1 and 62-2 include additional arcuate projections 64 which are adapted to slidably contact the front of the upright face 61 while minimizing friction therebetween.

Figure 11:
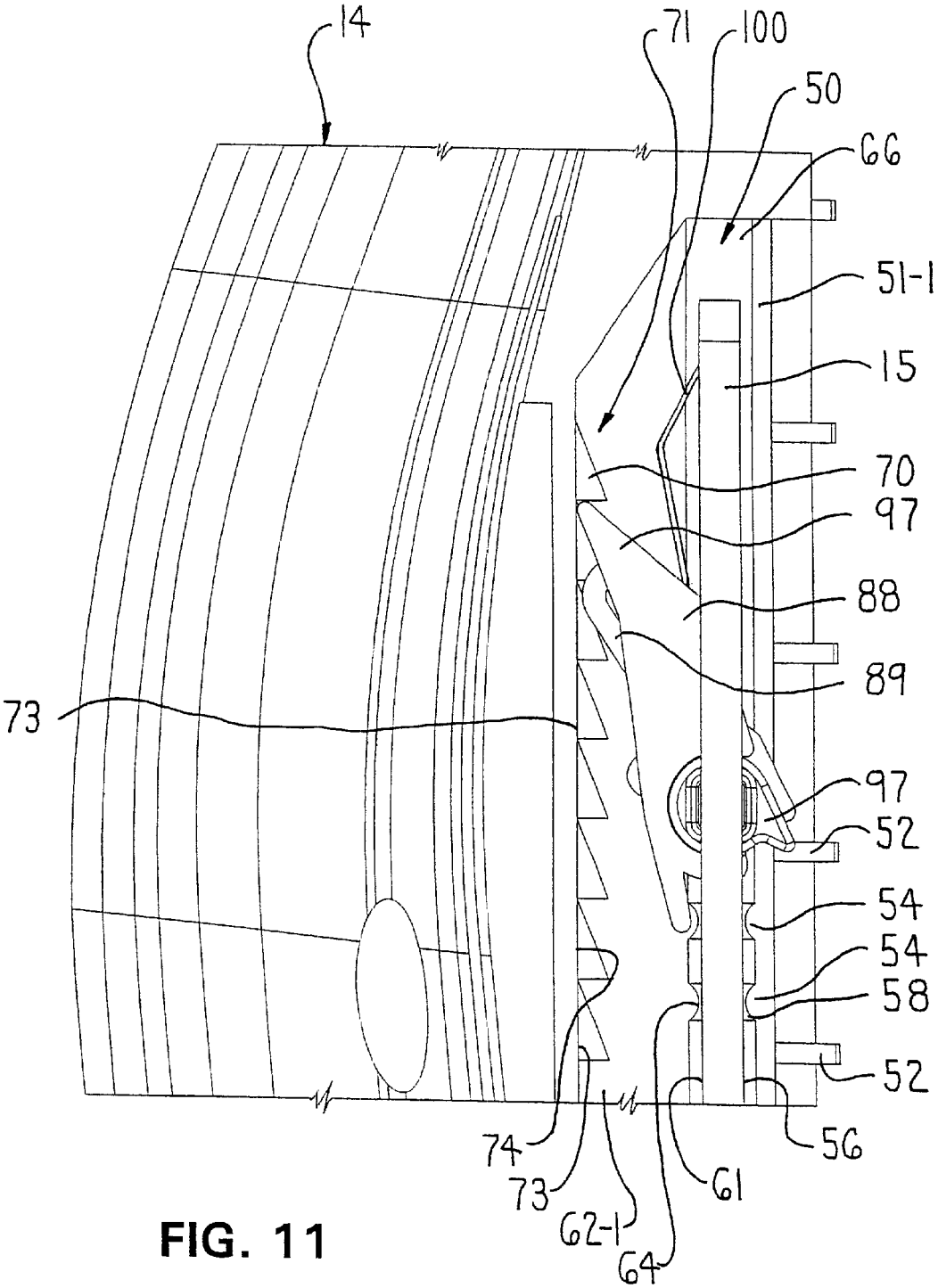
FIG. 11 is a partial side elevational view illustrating the latch engaged with a rack on the inner shell.
Figure 12:
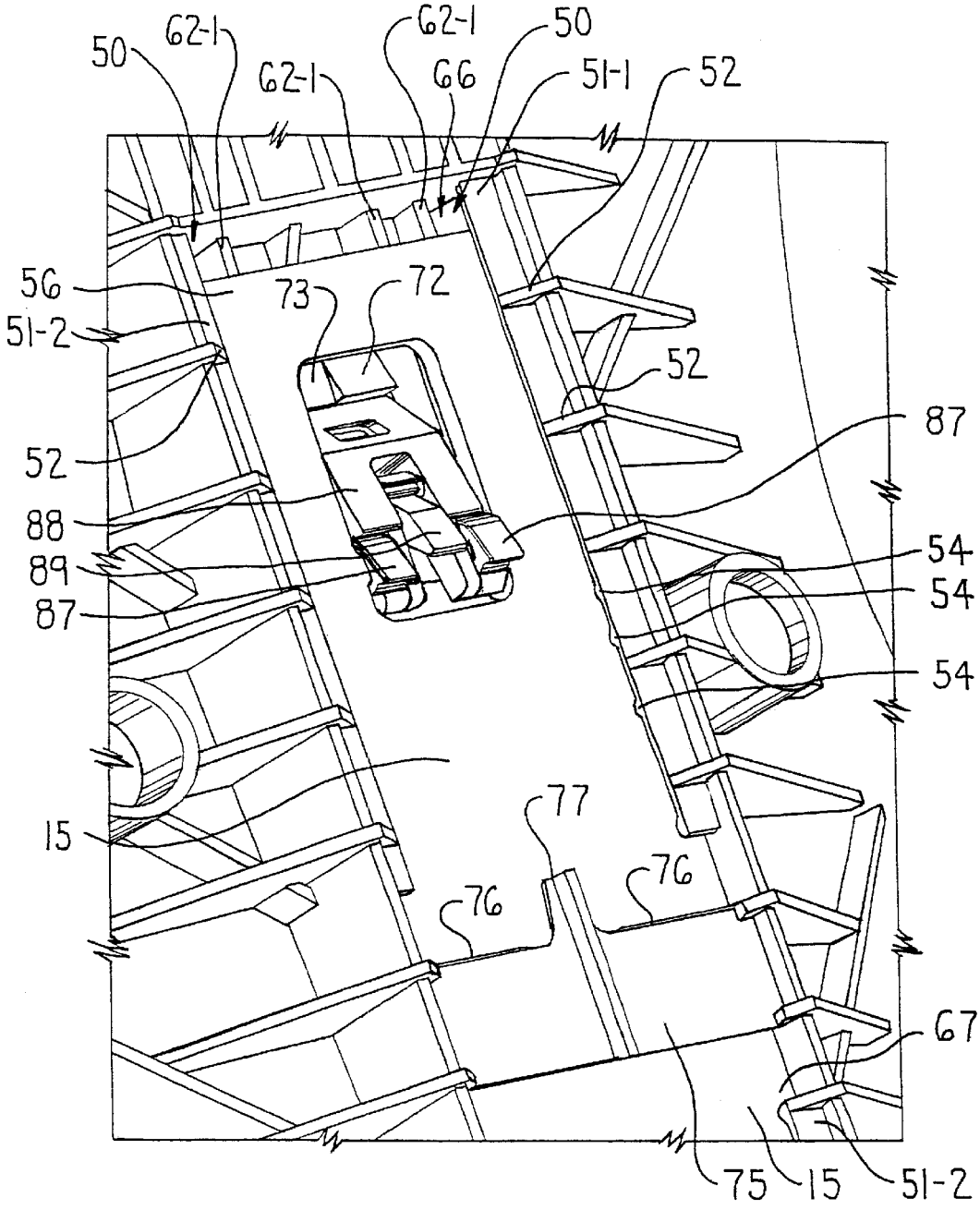
FIG. 12 is a rear perspective view of the height adjusting mechanism in the engaged position illustrated in FIG. 11.

With this arrangement, the opposite side edges 59 of the upright 15 are slidably received within the respective grooves 50 as more clearly illustrated in FIGS. 11 and 12. More specifically, the grooves 50 effectively include upper groove sections 66, which are defined by the upper flanges 51-1 and the upper pairs of ribs 62-1, and lower groove sections 67 (FIGS. 3 and 13), which are defined by the lower flanges 51-2 and the ribs 62-2. However, the upper groove sections 66 have a significantly longer vertical length than the lower grooves section 67 such that the upright 15 is primarily supported by the upper groove sections 66.

To provide vertical support to the height adjusting mechanism 17, the front pocket wall 46 further includes a plurality of teeth 70. The teeth 70 define downward facing steps and are disposed individually one above the other to define two parallel vertical rows such that the two rows of teeth 70 effectively define a rack 71. As generally illustrated in FIGS. 3 and 4, the rows of teeth 70 are sidewardly spaced apart in parallel rows to define a vertically elongate slot 73 therebetween having a slot face 74 which faces rearwardly toward the upright 15.

Additionally referring to FIGS. 3, 4 and 12, the inner shell 30 also includes a stop plate 75 which extends sidewardly between the pocket side walls 44 and is disposed generally below the lower end of the upper groove sections 66. The stop plate 75 has upper stop edges 76 which define the upper limit of travel of the back assembly, and an actuator block 77 which projects upwardly from the upper stop edges 76 to actuate or more particularly disengage the height adjusting mechanism at the upper travel limit and then permit lowering of the back assembly 14.

Figure 6:
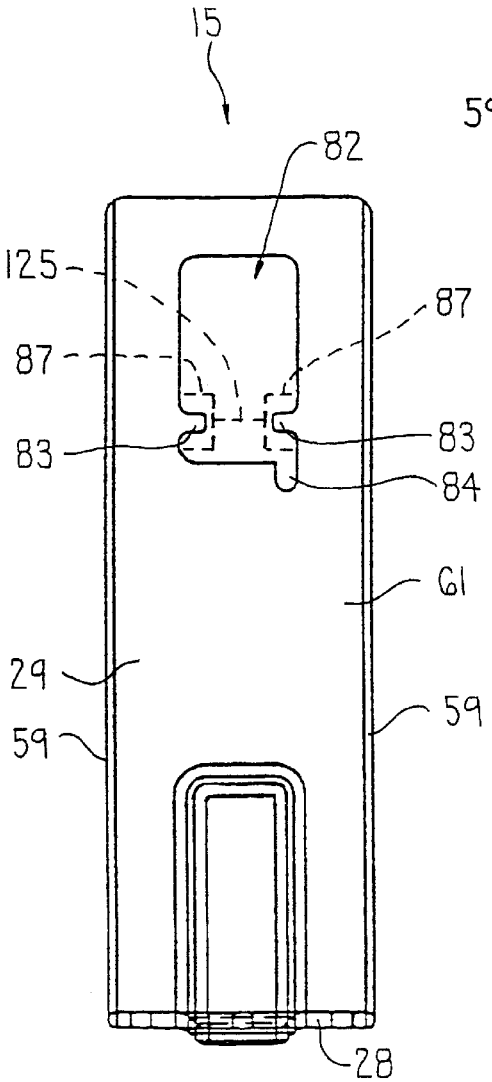
FIG. 6 is a front elevational view of the upright with the bearings illustrated in phantom outline.

Referring to FIGS. 5 and 6, the upright 15 is adapted to support the height adjusting mechanism 17 thereon as described in further detail hereinafter. The upright 15 is rigidly fastened to the control housing 26 by a plurality of apertures 80 at the front end of the horizontal leg 28.

The vertical leg 29 includes a support opening 82 near the upper end thereof which is generally rectangular and opens forwardly through the upright 15. The support opening 82 includes a pair of bearing supports 83 each of which projects inwardly toward each other from the opposite sides of the support opening 82. Additionally, a downwardly extending notch 84 is provided directly below one of the bearing supports 83 at a lower left corner of the opening 82.

Turning to the height adjusting mechanism 17, this mechanism generally includes: a pair of bearings 87; a rack-engaging latch 88 pivotally supported on the upright 15 by the bearings 87; and a lever-like cam 89 which is pivotally supported on the latch 88 and is operable to disengage the latch 88 from the rack 71 to permit lowering of the back assembly 14.

Each of the bearings 87 (FIGS. 7 and 8) includes a generally rectangular bore 91 that opens horizontally therethrough and is slidably fitted onto the bearing supports 83 of the upright 15. Since the bearing supports 83 and bores 91 have cooperating rectangular shapes as generally illustrated in FIG. 8, the bearing supports 83 are non-rotatable relative to the upright 15. To provide tight-fitting engagement, each bore 91 preferably includes a rib 91*a* on one side thereof.

Figure 13:
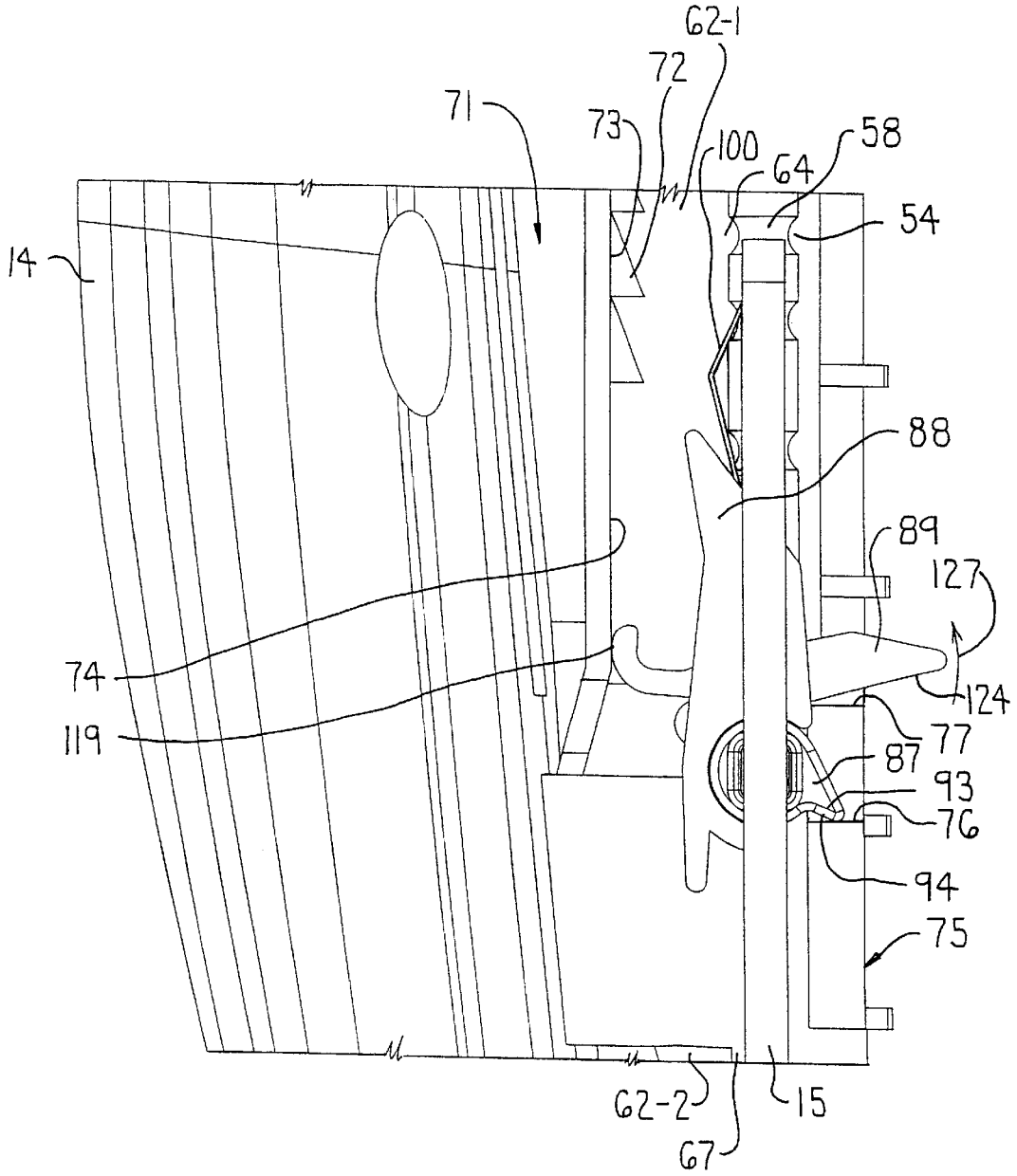
FIG. 13 is a side elevational view with the back assembly at the upper limit of travel wherein the cam lever is in a release position and the latch is disengaged from the rack.
Figure 14:
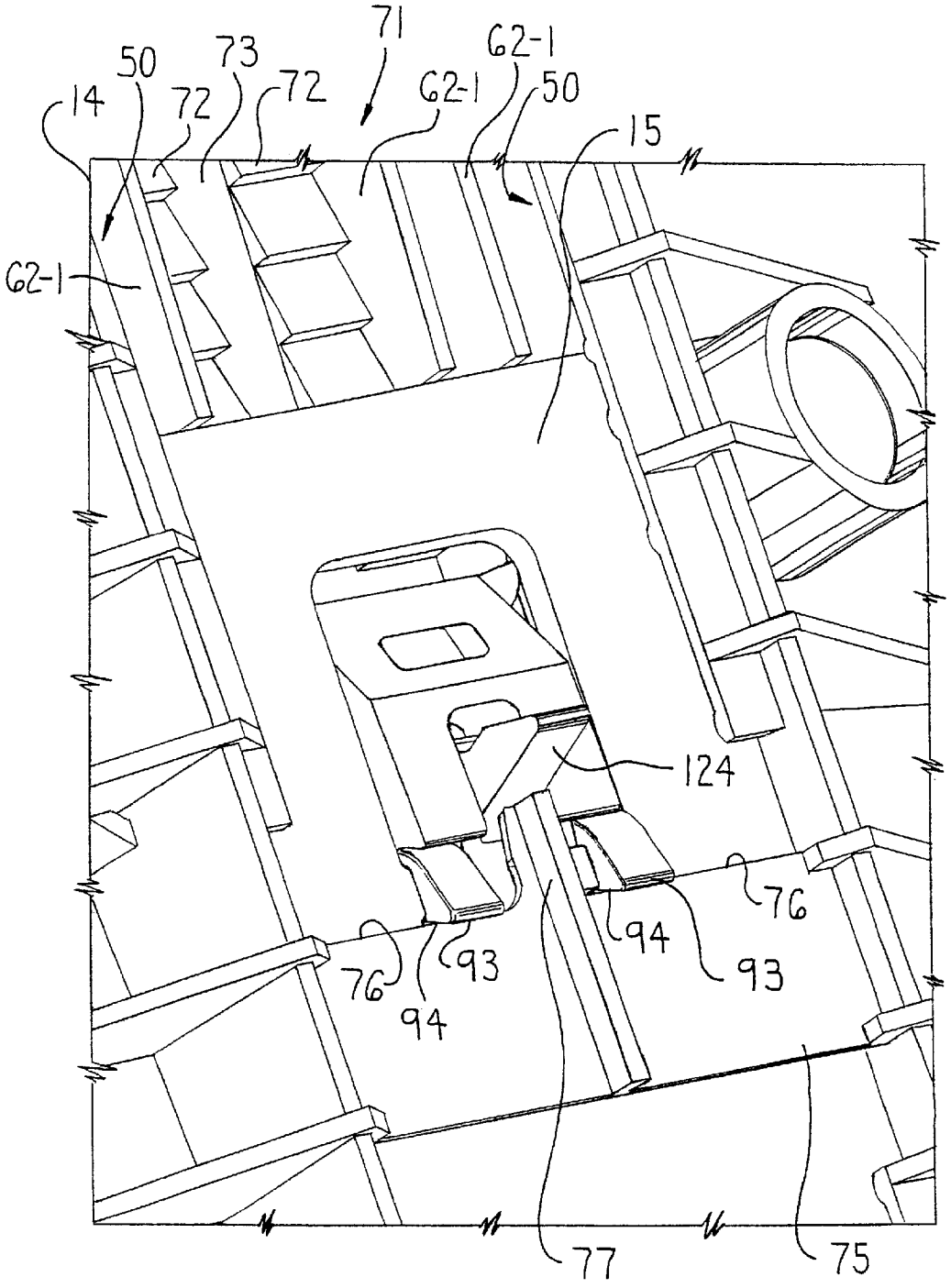
FIG. 14 is a rear perspective view of the height adjusting mechanism in the disengaged position illustrated in FIG. 13.

Each bearing 87 has a generally circular outer support surface 92, and a stop projection 93 that extends generally tangentially from the support surface 92. The stop projection 93 defines a downward facing stop surface 94 in order to contact the opposing stop edges 76 at the upper travel limit (FIGS. 13 and 14).

More particularly as to the latch 88, the latch 88 is preferably a one-piece molded plastic part that is adapted to be pivotally mounted to the upright 15 like a lever or pawl and cooperate with the rack 71 in ratcheting engagement therewith. To support the latch 88 on the upright 15, a pair of sideward opening bearing seats 96 are provided on the opposite sides thereof.

Referring to FIG. 8, each bearing seat 96 has a generally circular shape which is adapted to rotatably receive the bearing 87 therein. The bearing seat 96, however, is open on one side thereof so that the latch 88 can be snapped rearwardly onto the bearing seats 87 when the bearing seats 87 are fixed on the corresponding bearing supports 83 on the upright 15. As result, the latch 88 is pivotally supported on the upright 15 as generally illustrated in FIGS. 11 and 12.

More particularly, the latch 88 further includes an upper latch end 97 which projects upwardly and forwardly toward the rack 71. To resiliently bias the latch 88 toward the rack 71, the latch 88 includes a pair of spring slots 98 near the upper end thereof which are adapted to receive the lower ends 99 of a U-shaped biasing spring wire 100. The lower spring ends 99 hook into the spring slots 98 wherein the spring 100 projects upwardly above the latch 88.

After assembly, the spring 100 is disposed between the upper latch end 97 and the front face 61 of the upright 15 whereby the spring 100 presses rearwardly on the front upright face which thereby biases the latch 88 forwardly into engagement with the rack 71. The engagement position for the latch 88 is illustrated in FIG. 11 whereby the latch 88 engages the rack 71. Accordingly, downward movement of the back assembly 12 is prevented since a sidewardly adjacent pair of the teeth 70 abut downwardly on the latch 88.

However, the spring 100 also is resiliently deflectable to permit the latch end 97 to pivot outwardly away from the rack 71 as the back assembly 14 and specifically, the inner shell 30 thereof is moved upwardly. The latch 88 thereby slides relative to the teeth 70 in a manner similar to a ratchet. This permits the back assembly 12 to be raised to a new elevation merely by manually lifting the back assembly 12.

The spring 100 also is sufficiently deflectable to permit the latch 88 to be pivoted farther away from the rack 71 to the fully disengaged position illustrated in FIG. 13. To define the fully disengaged position, the latch 88 includes a stop finger 102 which projects downwardly therefrom and cooperates with the notch 84 defined in the upright 15.

To maintain the latch 88 in this fully disengaged position and thereby permit the back assembly 12 to be manually lowered, the cam 89 is provided which cam 89 is pivotally connected to the latch 88 as described hereinafter.

Figure 9:
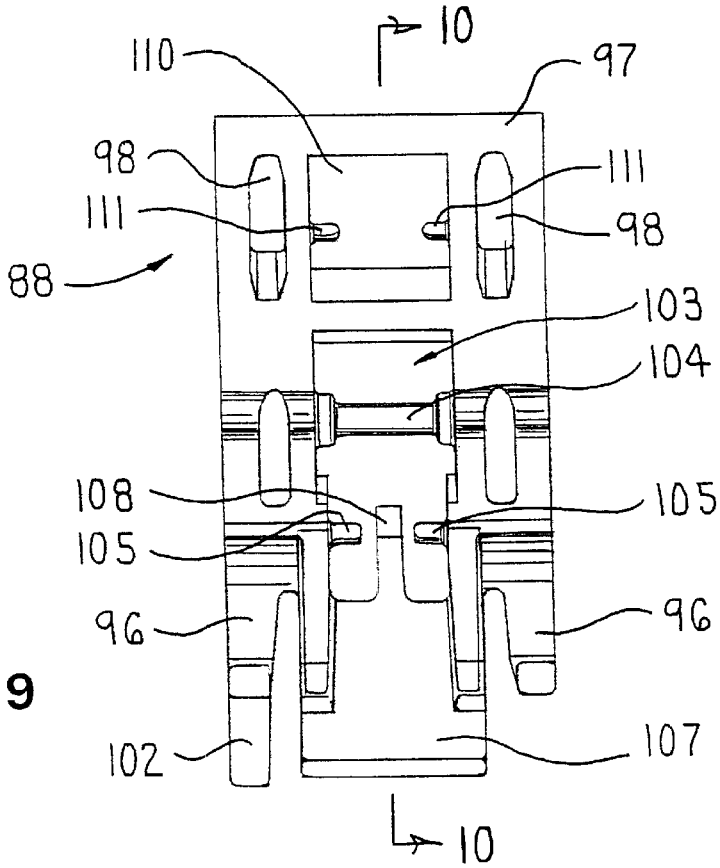
FIG. 9 is a front elevational view of a latch of the height adjusting mechanism.

To support the cam 89, the latch 88 (FIGS. 9 and 10) includes a lower rectangular opening 103 which includes a horizontal axle 104 extending therebetween which axle 104 is adapted to pivotally support the cam 89 thereon. The opening 103 further includes a pair of cylindrical lower stops or pins 105 which are disposed below the axle 104. Also, the bottom end of the opening 103 is spanned by a wall 107 wherein an upper edge of the wall 107 has a stop post 108 projecting upwardly therefrom.

Additionally, the latch 88 also includes an upper opening 110 which is disposed centrally between the spring slots 98. The upper opening 110 includes a pair of upper stops or pins 111 which project toward each other.

Figure 7:
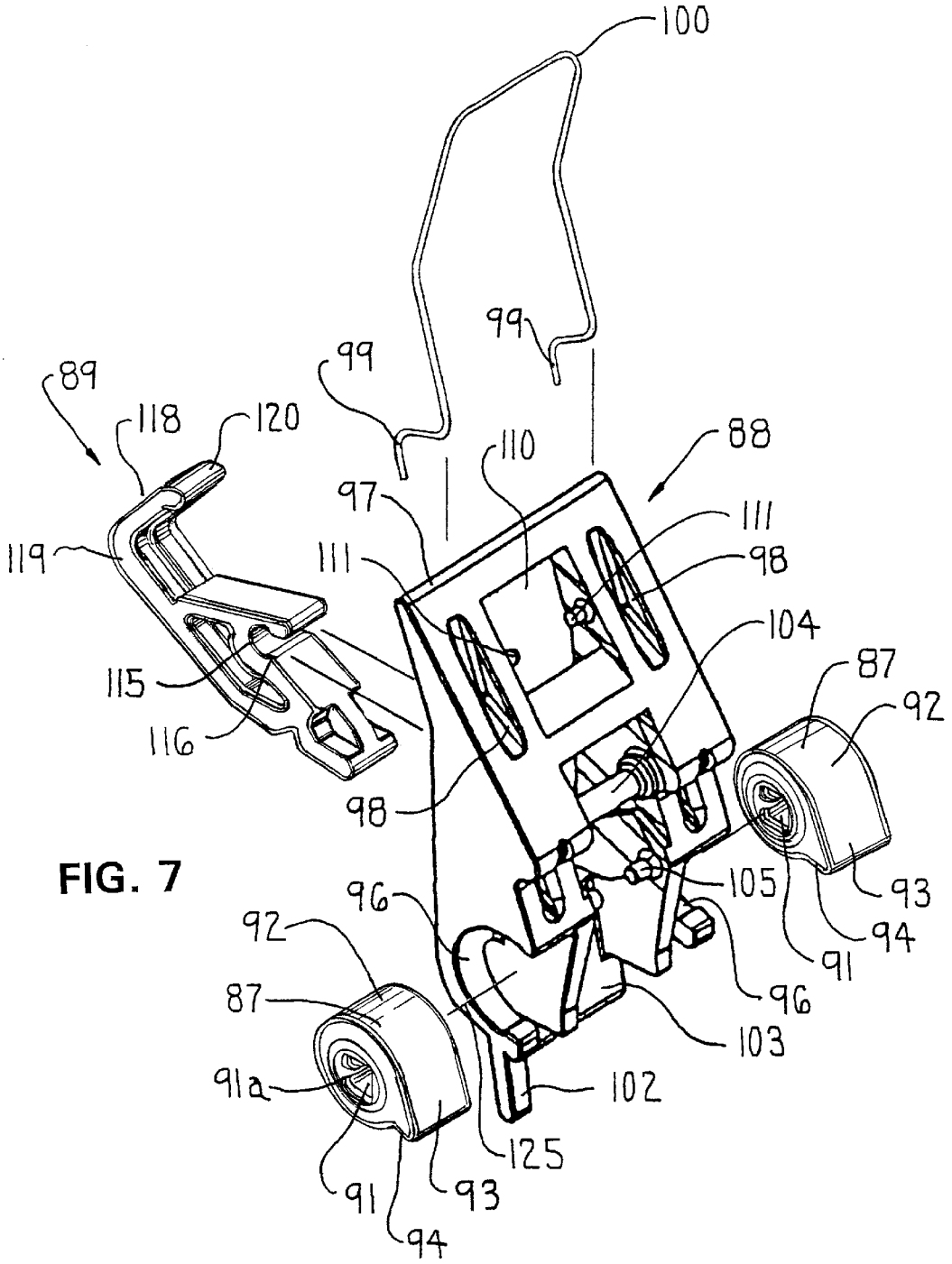
FIG. 7 is an exploded perspective view of the height adjusting mechanism including the bearings.
Figure 8:
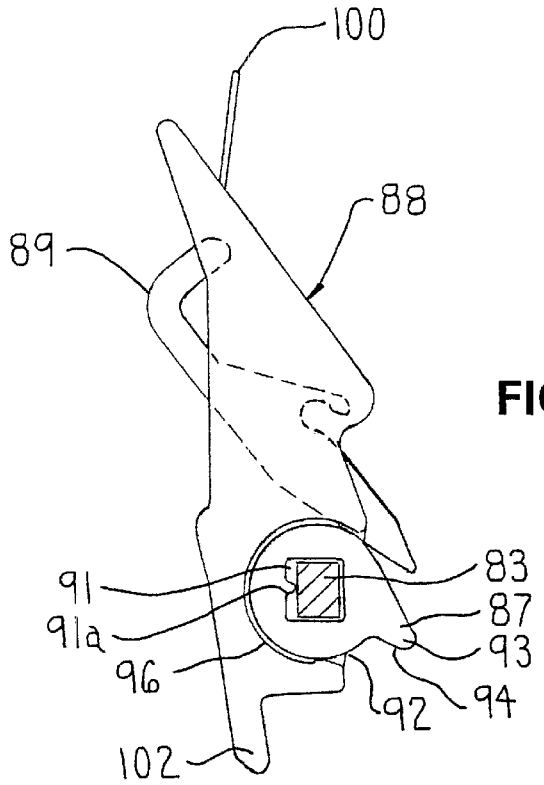
FIG. 8 is a side elevational view of the height adjusting mechanism.
Figure 10:
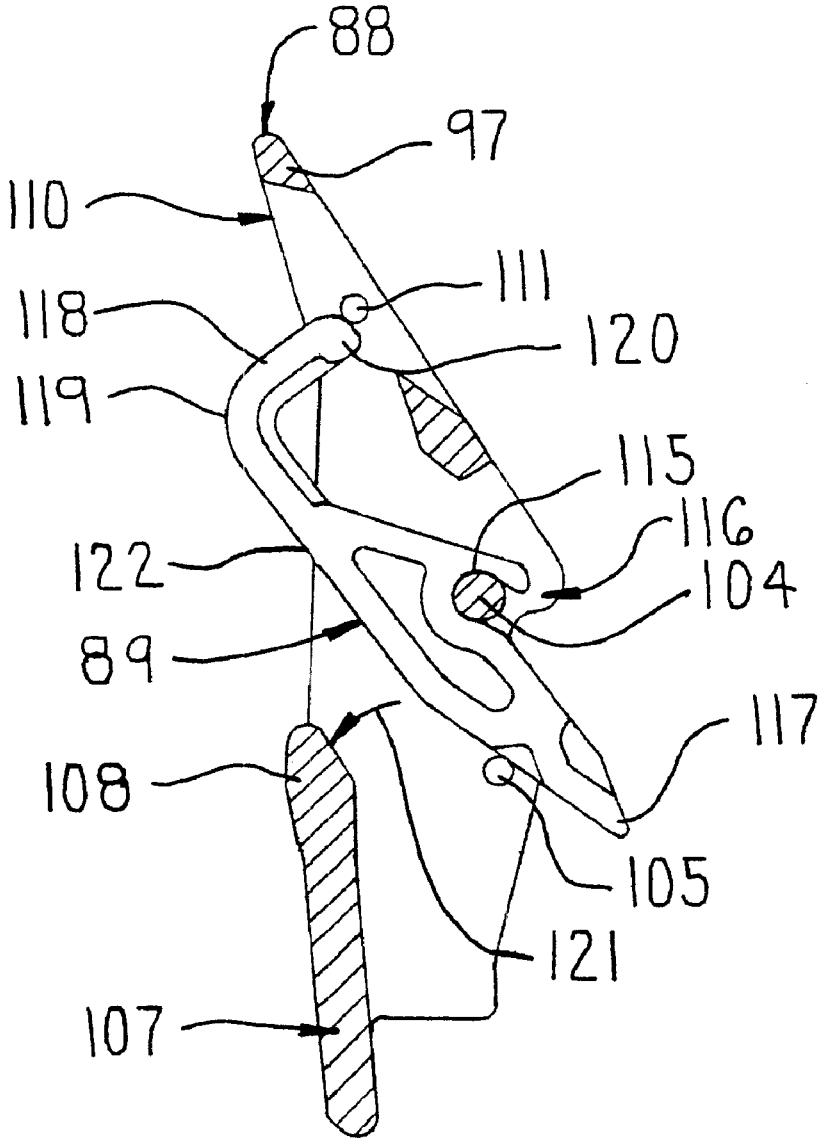
FIG. 10 is a side cross-sectional view of the latch as taken along line 10—10 of FIG. 9 with a cam lever connected thereto.

Turning to the cam 89, the cam 89, as illustrated in FIGS. 7 and 10, is formed as a molded one-piece plastic part which includes a horizontal channel or slot 115 approximately midway along the length thereof. The slot 115 is open along one side 116 so that the slot 115 of the cam 89 can be snap fittingly connected to the axle 104 in pivoting engagement therewith. Preferably, the open side 116 opens rearwardly away from the rack 71.

The lower end 117 of the cam 89 projects downwardly between the axle 104 and the pivot stops 105 on the latch 88. Additionally the upper end 118 thereof projects upwardly so as to be disposed vertically between the upper pivot stops 111 and the stop post 108. In this orientation, the upper end 118 defines a forward facing cam surface 119 and is generally L-shaped so as to project rearwardly and define a terminal end 120.

With this arrangement, the cam 89 is pivotable or rotatable about the horizontal axle 104 between a fully stored or a standby position as illustrated in FIG. 10 and an operative position as seen in FIGS. 13. When in the stored position of FIG. 10, the upper stop pins 111 contact the distal cam end 120 while the lower stop pins 105 abut against the lower end 117 of the cam 89. The cam 89 also is pivotable downwardly away from this position in the direction of reference arrow 121 to the operative position wherein the front face 122 of the cam 89 contacts and rests on the stop post 108. The lower section of the front face 122 also defines a contact surface 124 which is used to shift the cam 89 from the stored position of FIG. 11 to the operative position of FIGS. 13–15.

Since the cam 89 is mounted generally at the center of the latch 88, the upper end of the cam 89 and specifically, the L-shaped section which defines the cam surface 119 fits into and slides along the vertically elongate slot 73 that is defined between the parallel vertical rows of rack teeth 70. Therefore, while the latch 97 slides along the teeth 70 in operative engagement therewith, the cam surface 119 slides along the slot 73 near the opposing slot face 74.

During assembly, the bearings 97 are first mounted on the bearing supports 83 of the upright 15. Preferably, the latch 88, spring 100 and cam 89 are preassembled. As such, the cam 89 is snap fitted onto the axle 104 of the latch 88 while the lower ends 99 of the spring 100 are engaged with the spring slots 98. This assembly is then mounted onto the bearings 97 in snap fitting engagement therewith so that this assembly is disposed within the opening 82 formed in the upright 15 and is pivotable about the horizontal pivot axis 125 (FIG. 7) which extends horizontally between the axes of the bearings 87. With this arrangement, the latch 88 and cam 89 are pivotally supported on the upright 15 as a unit. Further, the cam 89 also is independently pivotable relative to the latch 88 about a pivot axis defined by the axis of the axle 104.

Once the back assembly 14 is mounted in place on the upright 15, the assembly is disposed within the pocket 36 formed in the chair shell 30. Referring to FIGS. 11 and 12, the latch 88 is biased forwardly by the spring 100 to the engagement positioned so that the upper end 97 thereof is engaged with the rack teeth 70. While the cam surface 119 projects forwardly somewhat into the region of the teeth 70, the cam 89 is in the stored position and thus, does not interfere with or contact the teeth 70 since the upper end 118 slides vertically within the slot 73. As such, the resilient deflection of the spring 100 permits the latch 88 to ratchet along the teeth 70 as the back assembly 14 is manually lifted. Each tooth 70 defines a different elevation whereby the chair occupant can manually set the elevation of the back assembly 14.

To permit lowering of the back assembly 14, the cam 89 is adapted to cooperate with the actuator block 77 of the inner shell 30 when the back assembly 14 is at the upper limit of travel as generally illustrated in FIGS. 13 and 14. In particular, the stop surfaces 76 of the inner shell 30 contact the bearing projections 93 so that further upward movement of the back assembly 14 is prevented thereby.

At this upper limit of travel, the actuator block 77 contacts the contact surface 124 on the cam 89 and thereby pivots the cam 89 in a counterclockwise direction as indicated by reference arrow 127. This counterclockwise movement of the cam 89 causes the upper cam end 118 to move forwardly into contact with the opposing surface 74 of the slot 73. Specifically, the arcuate cam surface 119 slidably contacts the slot surface 74. Since the slot 73 cannot be displaced away from the upright 15 as the inner shell 30 is fixed on the upright 15, this rotating movement of the cam 89 causes the interconnected latch 88 to pivot in the opposite direction away from the rack 71 to the fully disengaged position of FIG. 13.

To maintain the cam 89 in this operative position, the cam 89 is rotated sufficiently so as to move over center such that the spring force from the spring 100 that is transferred through the interconnection of the latch axle 104 and cam 89 continues to urge the cam 89 in the counterclockwise rotation. This counterclockwise rotation, however, eventually is stopped by the stop post 108 on the latch 97. Therefore, the cam 89 is maintained in the operative position even when the actuator block 77 begins to travel downwardly with the back assembly 14. Due to the frictional contact between the opposing slot face 74 and the cam surface 119, the cam 89 continues to be urged in the counterclockwise direction during downward movement of the back assembly 14.

Figure 15:
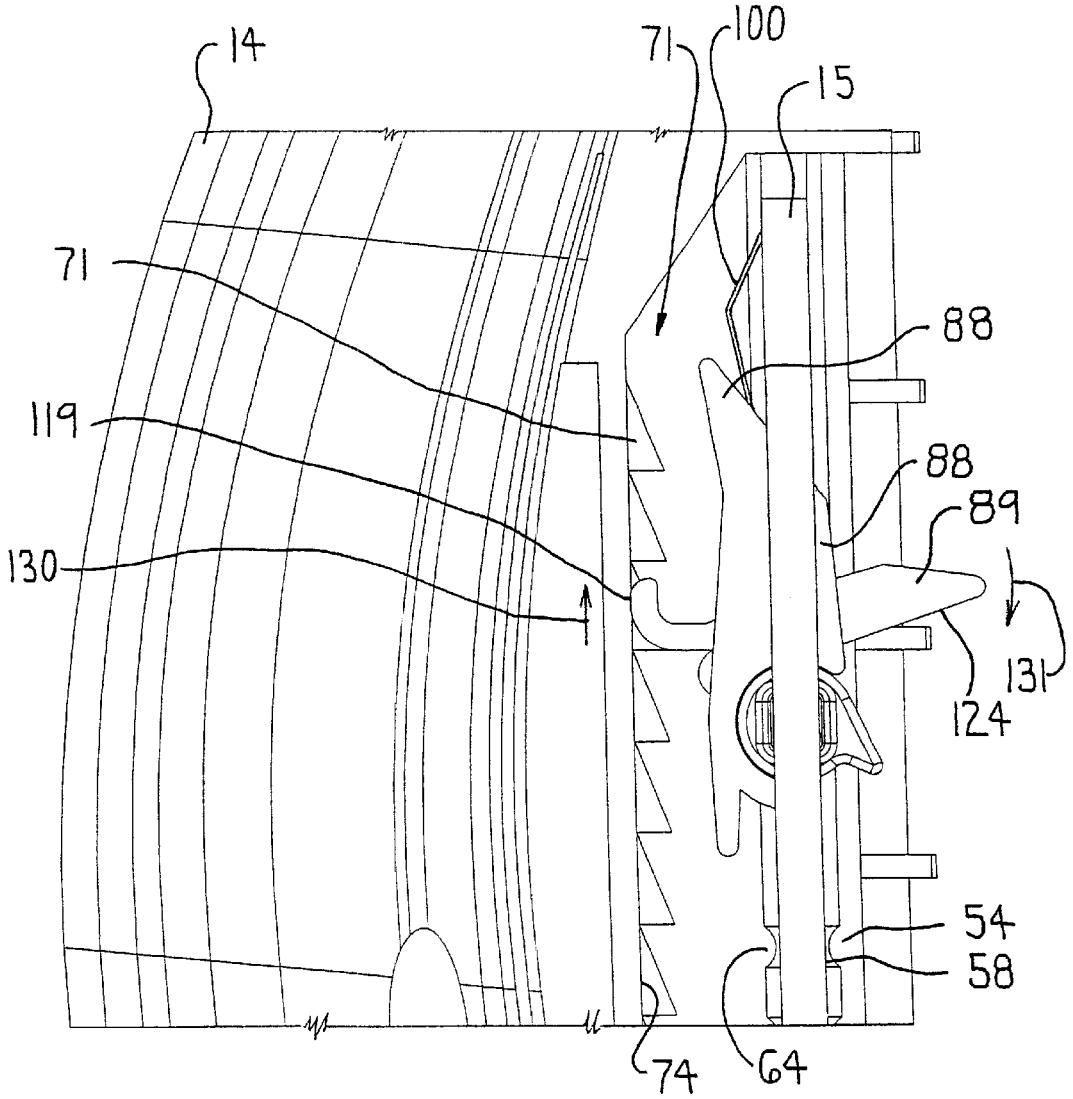
FIG. 15 is a side elevational view of the height adjusting mechanism near the lower limit of travel for the back assembly just prior to reengagement of the latch with the rack.

To release the cam 89 and permit reengagement of the latch 88, the cam 89 can be simply pivoted counterclockwise to the release position of FIG. 13 merely by shifting the back assembly 14 a short distance upwardly as generally illustrated in FIG. 15. In particular, near the lower limit of travel illustrated in FIG. 15 or any point between the upper and lower limits of travel, the back assembly 15 can be shifted upwardly as generally indicated by reference arrow 130. Due to the frictional contact between the slot face 74 and the cam surface 119, this upward shifting of the back assembly 14 causes the cam 89 to now rotate clockwise as generally indicated by reference arrow 131. Once the cam 89 is moved counterclockwise past the over center point, then the constant spring force from the spring 100 begins to urge the cam 89 clockwise rather than counterclockwise. Therefore the same spring 100 now acts to automatically return the cam 89 to the release position. As can be appreciated, at any elevation during the downward return stroke of the back assembly, the back assembly 14 can be reversed, i.e. shifted upwardly a short distance to disengage the cam 89 and reengage or reset the latch 88 with the rack 71. This allows the height of the back assembly 14 to be set at a desired elevation as soon as the elevation is reached and avoids having to return the back assembly 14 all of the way to the lower limit of travel before the latch 88 is reset.

With the above-described arrangement, disadvantages associated with prior art mechanisms are overcome.

In addition to the specific arrangement disclosed herein, modified versions of this arrangement also can be provided. For example, while the cam 89 is pivotally connected to the latch 88, the cam 89 also could be slidably connected thereto or independently slidably supported on the upright 15. Additionally, while the latch 88 is a rotating lever, the latch 88 also could be slidable, for example, horizontally toward- and away from the rack 77 wherein a cam is provided to press the latch away from the rack.

Additionally, these components can also be reversed in position wherein the lever and latch assembly are provided on the back assembly 14 while a rack is provided on the upright 15. Still further, this arrangement could be applied to other occupant supporting components of the chair 10 such as an armrest having an upright support member and an arm housing.

Although a particular embodiment of the invention has been disclosed in detail for illustrative purposes, it will be recognized that variations or modifications of the disclosed apparatus, including the rearrangement of parts, lie within the scope of the present invention.

What is claimed is:

1. A chair comprising:

a base having an upright;

a movable support member which has an occupant supporting surface and is movable vertically between upper and lower limits of travel to adjust a height of the supporting surface; and a height adjusting mechanism connected between said upright and said support member, said height adjusting mechanism comprising a latch and a cam on one of said upright and said support member and a vertical side wall and an actuator member on the other of said upright and said support member, said latch being movable toward and away from said side wall between an engaged position and a disengaged position in which said latch respectively engages and disengages said side wall to prevent and permit downward movement of said support member, said cam being moved from a standby position to an operative position by said actuator member when said support member approaches said upper travel limit such that said cam moves said latch to said disengaged position and permits downward movement of said support member, said cam being relatively movable along said side wall in contacting relation therewith when said cam is in said operative position such that upward movement of said support member at any point between said upper and lower travel returns said cam to said standby position to reengage said latch with said side wall.

2. The chair according to claim 1, wherein said cam is movable vertically between said standby position and said operative position, and said latch is movable sidewardly between said engaged position and said disengaged position.

3. The chair according to claim 2, wherein said cam is pivotally connected to said latch such that pivoting movement of said cam to said operative position moves said latch away from said side wall to said disengaged position.

4. The chair according to claim 2, wherein said side wall includes a plurality of vertically spaced apart stops which are individually engagable by said latch and further includes a vertically elongate contact surface along which said cam slides, said cam and said contact surface being in frictional contact which effects movement of said cam to said standby position when said support member is raised upwardly.

5. The chair according to claim 1, wherein said cam is a lever which is pivotable about a pivot axis, said lever having a first end on one side of said pivot axis which cooperates with said side wall and a second end on the opposite side of said pivot axis which cooperates with said actuator member.

6. The chair according to claim 5, wherein said cam is pivotally connected to said latch by a pivot connection which defines said pivot axis.

7. The chair according to claim 6, wherein said latch is pivotally connected to said one of said upright and said support member.

8. In a chair having a base, a seat assembly and a back assembly wherein said back assembly is connected to an upright which projects upwardly above said seat assembly, said back assembly being movable vertically between upper and lower limits of travel to adjust a height thereof, a height adjusting mechanism connected between said upright and said back assembly, comprising the improvement wherein said height adjusting mechanism comprises a plurality of stops on said back assembly, a latch supported on said upright which is engagable with said stops to maintain said occupant support surface at a selected elevation, said latch being movable between an engaged position in engagement with said stops and a disengaged position away from said stops which permits lowering of said occupants support surface, and a movable actuator member provided on said upright which is movable from a standby position to an operative position to separate said latch from said back assembly, said actuator member being in frictional contact with an opposing contact surface of said back assembly such that downward movement of said back assembly presses said actuator to said operative position and upward movement of said back assembly moves said actuator member to said standby position wherein said back assembly is prevented from moving downwardly as soon as said actuator member is returned to said standby position.

9. The chair according to claim 8, wherein said back assembly includes an abutment which contacts said actuator member at said upper travel limit to moves said actuator member from said standby position to said operative position.

10. The chair according to claim 8, wherein said latch is pivotally supported on said upright.

11. The chair according to claim 10, wherein said actuator member is pivotally supported on said latch.

12. The chair according to claim 8, wherein said actuator member is disposed between said latch and said stops when said actuator member is in said operative position such that said latch member is disposed in said disengaged position.

13. The chair according to claim 12, wherein said actuator member includes a cam surface which contacts said contact surface of said back assembly wherein said latch is moved to said disengaged position by said actuator member.

14. The chair according to claim 8, wherein said actuator member includes a first section connected to said latch and a second section which abuts against said contact surface when in said operative position such that said actuator member pushes said latch to said disengaged position.

15. A chair comprising:

a first chair component;

a second chair component, one of said first and second chair components being slidably connected to the other of said first and second chair components so as to be movable between an extended position and a retracted position; and a height adjusting mechanism connected between said first and second chair components, said height adjusting mechanism including a latch on said first chair component which is engagable with said second chair component wherein said latch when engaged permits extension but prevents retraction of said first and second chair components, said latch including a pivoting cam thereon which is pivoted into engagement with said second chair component to disengage said latch therefrom when said first and second chair components are in said extended position, said cam when engaged with said second chair component permitting retraction and said cam being disengaged in response to extension of said first and second chair components which thereby permits reengagement of said latch with said second chair component.

16. The chair according to claim 15, wherein said one of said first and second chair components is a back assembly and said other of said first and second chair components is an upright.

17. The chair according to claim 16, wherein said first chair component is said upright and said second chair component is said back assembly.

18. The chair according to claim 15, wherein said latch is pivotally connected to said first chair component.

19. The chair according to claim 15, wherein said latch engages a vertical row of teeth on said second chair component, said cam being slidable along an elongate contact surface extending along said teeth.

20. The chair according to claim 15, wherein said latch includes a biasing member which biases said latch into engagement with said second chair component.

* * * * *